United States Patent [19]

Smith

[11] Patent Number: 4,540,210

[45] Date of Patent: Sep. 10, 1985

[54] CABLE RELEASE MECHANISM

[76] Inventor: Gregory L. Smith, P.O. Box 1196, West Monroe, La. 71291

[21] Appl. No.: 544,951

[22] Filed: Oct. 24, 1983

Related U.S. Application Data

[63] Continuation-in-part of Ser. No. 407,574, Aug. 12, 1983, abandoned.

[51] Int. Cl.[3] ..... B63B 21/60; B66C 1/34

[52] U.S. Cl. ..... 294/82.34; 24/241 PS; 114/252; 294/82.27; 294/82.3

[58] Field of Search ..... 294/82 R, 83 R, 83 A, 294/83 AB; 24/230.5 R, 232 R, 241 P, 241 PP, 241 PS, 241 SL, 241 SB; 114/216, 217, 230, 249, 251–253

[56] References Cited

U.S. PATENT DOCUMENTS

| | | | |
|---|---|---|---|
| 37,681 | 2/1863 | De Garmo | 114/252 |
| 411,860 | 10/1889 | Hamaker | 294/83 R |
| 632,704 | 9/1899 | Fantroy | 294/83 R |
| 827,795 | 8/1906 | Foucher | 294/83 R |
| 937,800 | 10/1909 | Hazzard | 24/241 SL X |
| 1,802,224 | 4/1931 | Steigenberger | 294/83 R X |
| 2,818,229 | 12/1957 | Guthans | 114/251 X |
| 2,907,600 | 10/1959 | Lowery | 294/83 R |
| 3,134,154 | 5/1964 | Smith et al. | 294/83 R X |
| 3,319,991 | 5/1967 | Ratcliff | 294/82 R |
| 3,610,674 | 10/1971 | Janssen | 294/83 R |
| 3,811,720 | 5/1974 | Epstein | 294/83 R |
| 4,034,992 | 7/1977 | Epstein | 294/84 X |
| 4,145,795 | 3/1979 | Henry et al. | 24/241 PP |
| 4,152,814 | 5/1979 | Ito | 24/241 PS |

FOREIGN PATENT DOCUMENTS

| | | | |
|---|---|---|---|
| 447051 | 12/1912 | France | 24/241 PS |
| 1276 | of 1904 | United Kingdom | 24/241 PS |

*Primary Examiner*—Johnny D. Cherry
*Attorney, Agent, or Firm*—John M. Harrison

[57] ABSTRACT

An improved cable release mechanism for mounting on the deck of a towboat, tug and other applications and receiving one end of a tow cable to secure and selectively release a barge or system of barges, which mechanism includes a pelican hook pivotally mounted on a base which is secured to the deck of the towboat in closed, towing configuration by means of a keeper ring normally engaging and securing the pelican hook. Release of the tow cable from the pelican hook is automatically achieved by activating an air or hydraulic cylinder having a piston in cooperation with the keeper ring, to extend the cylinder piston and force the keeper ring from engagement with the pelican hook, allowing the pelican hook to pivot rearwardly responsive to the load on the tow cable. In a preferred embodiment the keeper ring releasably cooperates with the air or hydraulic cylinder piston by means of a spring and a keeper ring bolt and a ring nut is provided in cooperation with the keeper ring bolt to facilitate manual release of the keeper ring from the pelican hook in the event of malfunction of the cylinder. In a most preferred embodiment, the cable release mechanism is provided with a cover and is coupled to a loop in one end of the towing cable and the cable is looped around the towboat and barge deck fittings and back to a winch located on the towboat, in order to provide a desired degree of tension in the tow cable and for adjustment of the distance between the barge or barges and the towboat.

20 Claims, 6 Drawing Figures

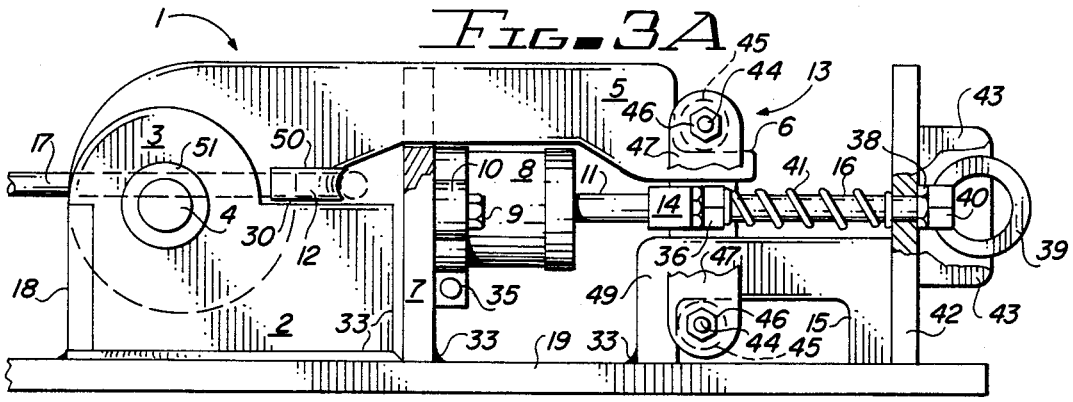
FIG. 3A
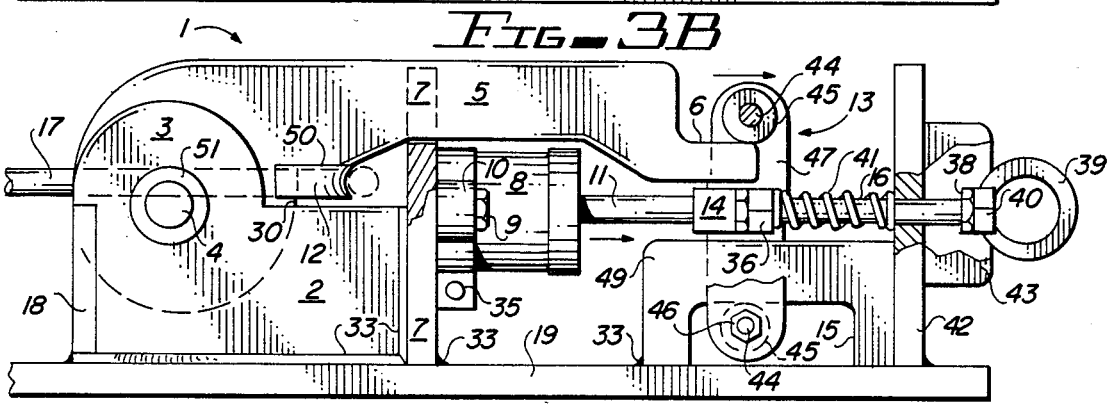
FIG. 3B
FIG. 3C
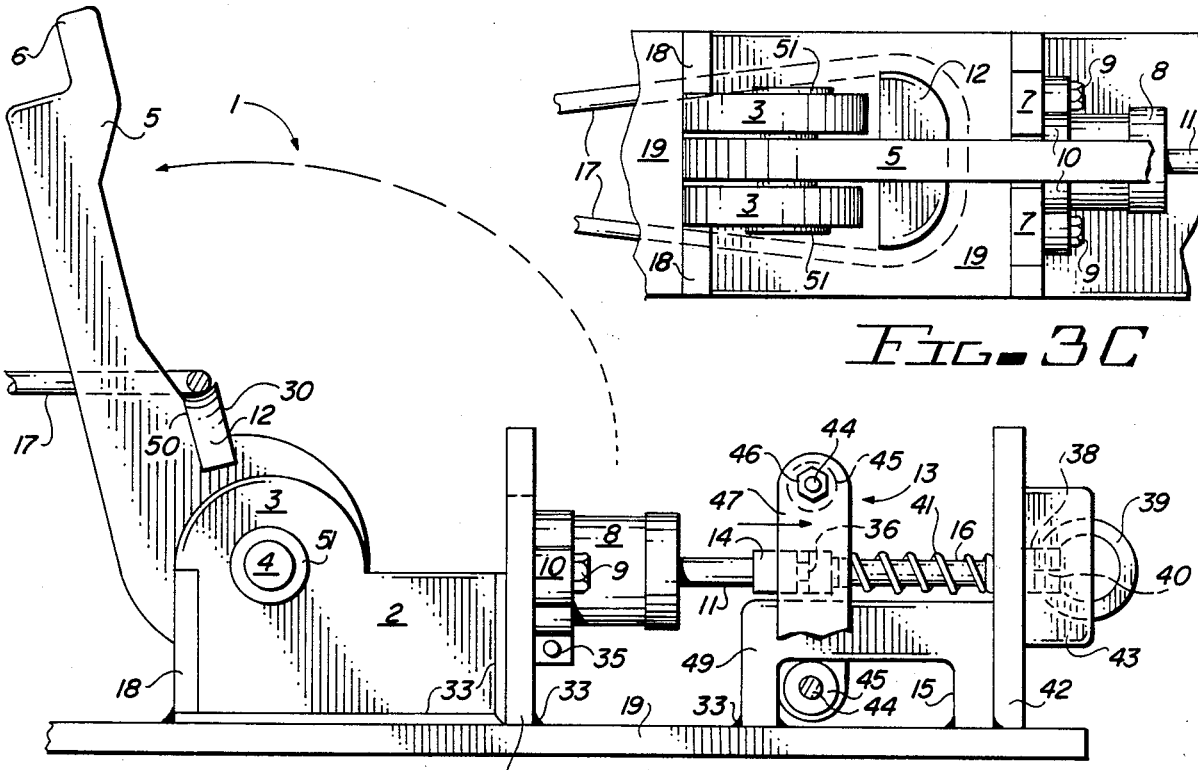
FIG. 3D

CABLE RELEASE MECHANISM

CROSS-REFERENCE TO RELATED APPLICATIONS

This application is a Continuation-In-Part of my copending Patent Application Ser. No. 06/407,574, filed Aug. 12, 1983, now abandoned.

BACKGROUND OF THE INVENTION

1. Field of the Invention

This invention relates to release mechanisms for quickly releasing towboats and tugs from one or a string of barges attached to the towboat by means of towing cables. More particularly, the invention relates to a remote control cable release mechanism which improves the conventional pelican hook release devices currently in use. In a typical river barge towing arrangement according to this invention the towboat is connected to a string of barges by means of steel tow cables which may be as large as 1½ inches in diameter. The tow cables are typically looped through a pelican hook and keeper ring device mounted on the deck of the towboat and around the towboat and barge deck fittings to one or more winches for adjusting the distance between the lead barge or barges and the towboat. The end of each towing cable which is attached to a pelican hook is typically provided with a loop which fits around the neck of the pelican hook near the point of pivot of the pelican hook in the base. The free end of the pelican hook is then pivoted downwardly and forwardly while the cable is slack to facilitate manipulation of a keeper ring, which is slidably attached to the base, over the pelican hook end. The keeper ring thus deployed prevents the pelican hook from pivoting rearwardly on its hinges and releasing the cable loop when tension is placed on the cables by the winch. The barges are then manipulated into alignment with the towboat and are maintained in this orientation while the barges are being towed. Accordingly, in the event of an emergency which requires release of the barges from the towboat, the keeper ring can removed by remote control from the end of the pelican hook, or it can be manually removed by means of a bar or screwdriver during the towing operation.

2. Description of the Prior Art

Conventional pelican hook cable retaining mechanisms have long been used on towboats to releasably secure towing cables to barges and are generally characterized by an elongated pelican hook which is pivotally attached to a pair of hinges welded to a base plate or to the deck of the towboat. The base plate is in turn bolted or otherwise secured to the deck of the towboat and a keeper ring is loosely mounted on a keeper ring stay, which is also welded or otherwise attached to the base or towboat deck adjacent the free end of the pelican hook. Accordingly, the keeper ring is slipped over the end of the pelican hook when the pelican hook is rotated downwardly on the hinges to secure the cable loop of a towing cable between the pelican hook and the base plate or towboat deck and the keeper ring can be removed from the end of the pelican hook during the towing operation by sharply striking it with a sledgehammer to release the cable loop and cable. A disadvantage of manually releasing the keeper ring from the end of the pelican hook in this manner is found in the large amount of stress which is placed on the pelican hook and the keeper ring during towing of a barge or barges.

The rearward force on the pelican hook assembly due to the weight of the barge or barges and the force of the towboat pulling the barge string causes the pelican hook to press tightly against the keeper ring. Accordingly, considerable force is required to dislodge the keeper ring from the end of the pelican hook. Accomplishing this act with the aid of a sledgehammer has resulted in injury to the operator, since the force of the pelican hook rapidly pivoting upwardly and rearwardly after the keeper ring is dislodged under towing conditions has, on occasion, knocked the sledgehammer completely out of the hands of the operator. Another disadvantage of the conventional pelican hook is the typically narrow neck or cable-bearing area, which frequently caused flattening and sometimes failure of the cable due to the large stresses applied to the cable.

The most pertinent automatic release mechanism relating to the instant invention which is known to applicant, is the "Underwater Release Mechanism" disclosed in U.S. Pat. No. 3,504,407, dated Apr. 7, 1970, to K. R. Dawson. This device is normally positioned between an anchor and a buoyant member in a water body and includes a housing bifurcated at its lower end and containing a solenoid. The housing is bifurcated in order to receive a pair or interacting lever members and the lower of these members terminates in a hook which is normally positioned to confine a loop member attached to the anchor. When the solenoid is energized, an armature is pulled away from the upper member to release it and this action permits the buoyant force to rotate both of the lever members to release the loop member, allowing the entire device to be carried to the surface by the buoyant member.

One of the problems associated with prior art remote control release mechanisms is the complexity of such devices, a factor which sometimes results in malfunction of the devices due to the relatively large number of parts which must interact in a certain way to achieve the desired result. Furthermore, as heretofore described, conventional manually operated pelican hook and keeper ring cable stay devices are dangerous to trip and require an operator to be in a dangerous position in an emergency. Accordingly, it is an object of this invention to provide a new and improved pelican hook cable release mechanism which is simple in design, easy to operate from a safe and remote location on the boat and includes an improved pivoting pelican hook and positive keeper ring assembly in cooperation with a fluid-activated cylinder to selectively engage and secure a tow cable during barge towing operations and quickly, easily and remotely or manually release the tow cable from the cable release mechanism in the event of an emergency.

Another object of the invention is to provide a new and improved remote control or manual cable release mechanism of the pelican hook and keeper ring design for securing and selectively releasing a tow cable from a tow boat in barge towing operations, which mechanism includes a pelican hook assembly fitted with a hydraulic or air cylinder and a keeper ring, keeper ring spring, ring nut, ring and keeper ring bolt assembly in cooperation with the cylinder piston, with the keeper ring in normally engaged position on the end of the pelican hook during the towing operation and operationally displaced from the end of the pelican hook in remote control mode by activation of the air or hydraulic cylinder and extension of the cylinder piston, or in manual mode, by manual engagement of the ring on the ring nut, when it is desired to release the tow cable and separate the towboat from the barge or barges.

A still further object of the invention is to provide a remote control or manually operated, improved pelican hook and keeper ring cable release mechanism which can be mounted to the deck of a towboat and utilized in cooperation with a standard winch system on the towboat to releasably secure one end of a tow cable and bind a barge string to the towboat, which cable release mechanism is characterized by a pelican hook pivotally mounted on a hinge or hinges attached to a base and a cooperating keeper ring, keeper ring bolt, ring nut, ring and spring cooperating with the piston of a hydraulic or air cylinder also mounted on the base, which cylinder can be activated to extend the cylinder piston against the bias of the spring and remove the keeper ring from contact with the pelican hook in automatic operation, and which ring can be engaged to manually remove the keeper ring from contact with the pelican hook in manual mode, in an emergency situation to release the tow cable from the pelican hook and the towboat.

Yet another object of the invention is to provide an improved automatic or manual cable release mechanism incorporating a pelican hook and a keeper ring assembly and a shaped cable seat on the pelican hook, which mechanism can be mounted to the deck of a towboat for securing the looped end of a tow cable to the pelican hook and removably securing the pelican hook in folded, closed position on the hinges by means of a keeper ring which cooperates by means of a block, a keeper ring bolt, a spring and a ring nut carrying a ring, with the piston of an air cylinder provided with a solenoid valve and appropriate remote controls, in order to facilitate remote activation of the air cylinder and extension of the cylinder piston in remote control operation, or manual engagement with the ring to remove the keeper ring from the pelican hook and release the cable under towing conditions, in the event of an emergency.

SUMMARY OF THE INVENTION

These and other objects of the invention are provided in a new and improved, selectively remote control or manually operated pelican hook and keeper ring cable release mechanism for mounting on the deck of a towboat and releasibly securing a tow cable to the towboat and one or more barges, which mechanism includes a pelican hook pivotally mounted on a hinged base and an air or hydraulic cylinder mounted on the base and having a piston in cooperation with the keeper ring and with a spring-loaded ring nut and keeper ring bolt mechanism, the keeper ring slidably attached to the base and oriented with respect to the piston for engagement with the end of the pelican hook when the piston is retracted to secure the pelican hook in towing configuration when tension is placed on the towing cable. The air or hydraulic cylinder can be remotely activated by means of solenoid, air or hydraulic valves, or other valving techniques and accessory fluid pressure equipment to automatically extend the piston and disengage the keeper ring from the end of the pelican hook to release the towing cable in the event of an emergency. The cable release mechanism can also be manually operated by engaging a ring on the ring nut and displacing the keeper ring bolt and the attached keeper ring from the pelican hook against the bias of the spring.

BRIEF DESCRIPTION OF THE DRAWING

The invention will be better understood by reference to the accompanying drawing, wherein:

FIG. 3*a* is a left side view of the cable release mechanism illustrated in FIG. 2, partially in section with the loop of a tow cable in functional configuration;

FIG. 3*b* is a left side view of the cable release mechanism illustrated in FIGS. 2 and 3*a*, partially in section and in partially released orientation, illustrating the automatic and remote function for releasing the cable;

FIG. 3*c* is a plan view, partially in section, of the hinges and rear segment of the cable release mechanism, more particularly illustrating deployment of a cable on the cable seat; and FIG. 3*d* is a left side view of the cable release mechanism, showing the pelican hook component of the cable release mechanism in disengaged orientation.

DESCRIPTION OF THE PREFERRED EMBODIMENT

Figure 1:
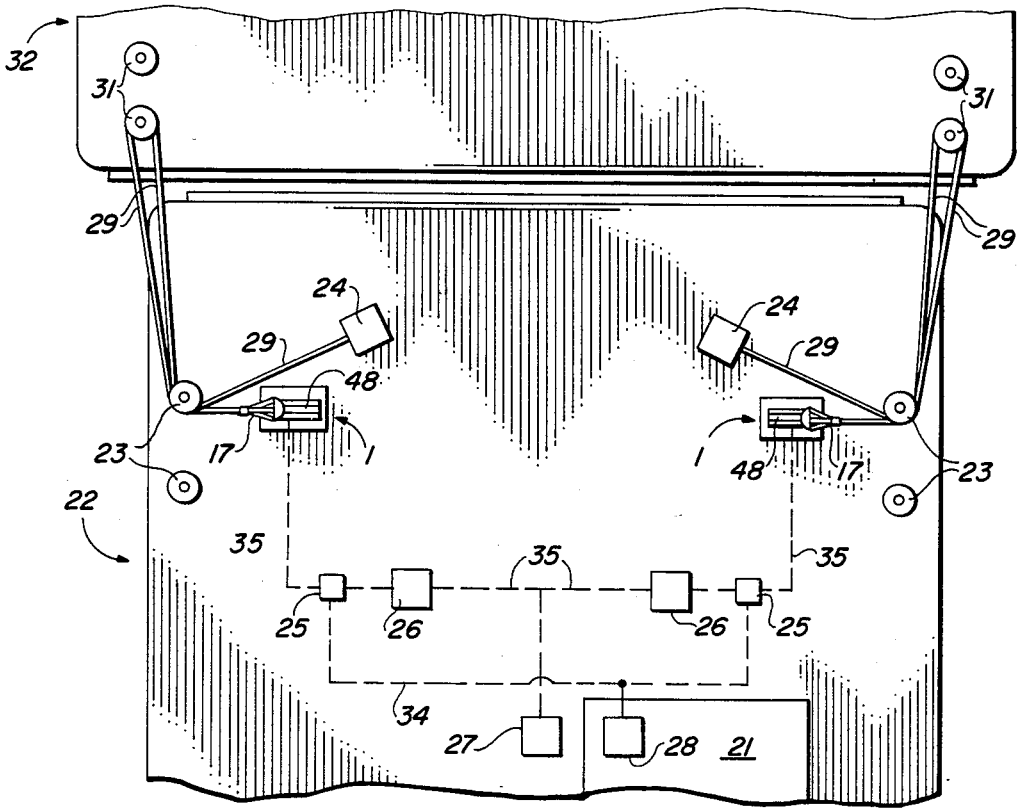
FIG. 1 is a plan view, partially in section, of a preferred cable release mechanism orientation on the deck of a towboat, with a cooperating winch system and cable release remote control apparatus.

Referring now to FIGS. 1–3*a* of the drawings the improved cable release mechanism of this invention is generally illustrated by reference numeral 1 and includes a base plate 19, carrying a pair of upward standing hinge mounts 2, shaped to form hinges 3 and provided with an aperture (not illustrated) to receive a hinge pin 4. Hinge pin keepers 51 are welded to each end of the hinge pin 4 in order to retain the hinge pin 4 in the hinges 3. A pelican hook 5 is hingedly mounted on the hinge pin 4 between the hinges 3 and extends horizontally forward of the hinges 3 and over the base plate 19 when in closed configuration, as illustrated in FIGS. 2, 3*a*, 3*b*, and 3*c*. The free end of the pelican hook 5 is provided with a recessed keeper ring seat 6 and the pivoted end of the pelican hook 5 is further provided with a curved cable seat 12, which extends from one side of the lower segment of the pelican hook 5 to the opposite side in a smooth curve, as illustrated. In a preferred embodiment of the invention the cable seat 12 is concave in configuration along the outer, cable-engaging surface or face and extends slightly beyond and rearwardly of the front edges of the hinges 3, in order to prevent the tow cable loop 17 of a tow cable 29 from touching either the hinges 3 or the hinge pin 4, as illustrated in FIG. 3. This objective is further accomplished by providing a cable support plate 18, attached to the base plate 19 and to the hinges 3 by means of a weld 33, as illustrated in FIG. 3*c*, to support the tow cable loop 17. In another preferred embodiment the hinge mounts 2 are secured to the base plate 19 by means of a weld 33 and are strengthened by the cable support plate 18. A cylinder mount plate 7 extends vertically from the base plate 19 forward of the hinge mounts 2 and parallel to the cable support plate 18 and in yet another preferred embodiment of the invention, the cylinder mount plate 7 is also welded to the base plate 19 at a weld 33 and to the hinge mounts 2 by yet another weld 33. A fluid-operated cylinder 8 is secured to the cylinder mount plate 7 by means of mount bolts 9, which register with apertures (not illustrated) in cylinder flanges 10, provided in the fluid-operated cylinder 8. The piston 11 of the cylinder 8 extends forwardly of the cylinder 8 in generally parallel relationship to the closed pelican hook 5 and engages a block 14, which is welded or otherwise attached to the keeper plates 47 of a vertically-oriented keeper ring 13. The keeper ring 13 is defined by a pair of parallel keeper plates 47, spaced by the block 14 and by a pair of shims 45 and joined by seat bolts 44, extending through the shims 45, respectively, in spaced relationship. Seat nuts 46 serve to tighten the seat bolts 44 against the keeper plates 47, and to allow the shims 45 to rotate on the seat bolts 44. The bottom one of the seat bolts 44 is slidably carried by a stay slot 15, provided in a keeper ring plate 49, which is mounted by means of a weld 33, to the base plate 19.

In a most preferred embodiment of the invention the piston 11 is maintained in contact with one side of the block 14 and the bolt head 36, of a keeper ring bolt 16, is secured to the opposite side of the block 14. The extending end of the keeper ring bolt 16 is slidably mounted in a spacer plate 42, secured to the base plate 19 in spaced relationship with respect to the keeper ring 13 by means of a weld 33. A keeper ring spring 41 is positioned between the spacer plate 42 and the bolt head 36 of the keeper ring bolt 16, in order to bias the keeper ring 13 against the piston 11 of the cylinder 8. A threaded ring nut 40, carrying a ring 39, is secured to threads 37, provided on the extending end of the keeper ring bolt 16 which projects through the spacer plate 42. A lock nut 38 serves to secure the ring nut 40 on the threads 37.

Figure 2:
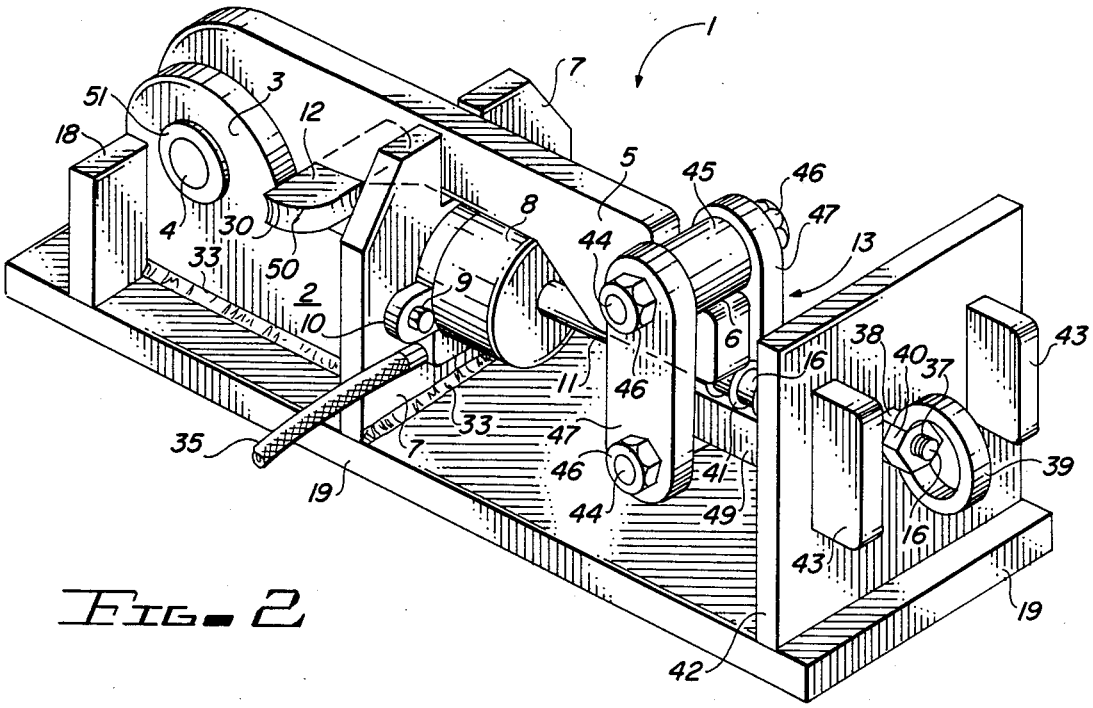
FIG. 2 is perspective view of preferred embodiment of the cable release mechanism illustrated in FIG. 1, with the cover removed.

As illustrated in FIGS. 2, 3*a* and 3*b*, the keeper ring 13 is displaced toward the cylinder 8 by action of the keeper ring spring 41, upon retraction of the piston 11 into the cylinder 8 and when the keeper ring 13 is so displaced, the top one of shim 45 is in engagement with the keeper ring seat 6 shaped in the free end of the pelican hook 5. Accordingly, it will be appreciated that when the keeper ring 13 is thusly oriented, the pelican hook 5 is prevented from upward and rearward pivotal displacement on hinge pin 4 and the tow cable loop 17, illustrated in FIG. 3, is secure on the curved cable seat 12.

Referring again to FIG. 1 of the drawings, a typical plan layout, partially in section, of two of the cable release mechanisms 1, provided with covers 48, of this invention is shown on the towboat deck 20 of a towboat 22, with a single barge 32, also illustrated in section, secured to the towboat 22 by a pair of tow cables 29. In a typical towing arrangement, the tow cable loop 17 of each one of the tow cables 29 is first secured to the cable release mechanism 1 in the manner illustrated in FIGS. 1 and 3*a*–3*d*, as hereinafter described. The tow cables 29 are then each wound around one of the towboat deck fittings 23, around one of the barge deck fittings 31 and subsequently back around the towboat deck fittings 23 to a winch 24. In this manner each winch 24 can be activated to locate the barge 32 in a desired proximity with respect to the towboat 22 and secure a proper barge towing orientation. It will be appreciated by those skilled in the art that multiple barges can be secured to the towboat 22 to form a "string" or "tow", according to the knowledge of those skilled in the art, the particular cable arrangement shown in FIG. 1 being illustrative only.

In another most preferred embodiment of the invention each cylinder 8 of the cable release mechanism illustrated in FIG. 1 is air-operated in cooperation with a system of associated operational components which includes solenoid valves 25 and cooperating air filters 26, which air filters 26 may also serve the function of lubricating the air supplied by a compressor 27, which air is used to operate the respective cylinders 8. A suitable control panel 28 may be provided in the wheel house 21 or elsewhere on the towboat 22, as desired, and the control lines 34 and air lines 35 can be positioned and oriented as deemed most expedient by the operators. Furthermore, it will be appreciated by those skilled in the art that the cylinders 8 can be hydraulic in function and the air lines 35 can be replaced by hydraulic fluid lines, according to the knowledge of those skilled the in art. However, in a most preferred embodiment of the invention air is the fluid of choice in operating each cylinder 8, primarily because of the ease of operation and reduced cost.

Referring again to FIGS. 1, 3*b* and 3*d* of the drawings, when a barge 32 or multiple barges of similar design are attached to the towboat 22 in the manner illustrated, or by other towing techniques known to those skilled in the art utilizing the cable release mechanism 1, it sometimes becomes necessary to release the barge 32 from connection with the towboat 22 for safety reasons. Accordingly, in the event of an emergency which requires such a separation, the appropriate control mechanism on control panel 28 is manipulated and the cylinder 8 of each cable release mechanism is activated. This action forces the keeper ring 13 forward in the stay slot 15 and the keeper ring bolt 16 in each cable release mechanism 1 forward in the direction of the arrow against the bias of the keeper ring spring 41, as illustrated in FIG. 3*b*, to the position illustrated in FIG. 3*d*, where the top one of the shims 45 is removed from the keeper ring seat 6. This operation causes the pelican hook 5 to swing rearwardly responsive to the tension in the tow cables 29, to quickly and effectively release the tow cables 29 from connection with the cable release mechanism 1 and effects the desired separation between the towboat 22 and the barge 32, freeing the towboat 22 to maneuver out of danger. The cable release mechanism 1 is then in a fully released configuration and the tow cable loops 17 of the cables 29 can be easily reattached to each pelican hook 5, respectively, by placing each respective tow cable loop 17 around a corresponding cable seat 12 and again pivoting the pelican hook 5 into the position illustrated in FIGS. 3*a*–3*c*. Retraction of the piston 11 in the cylinder 8 responsive to energizing of the appropriate solenoid valve 25 then reengages the keeper ring 13 on the keeper ring seat 6 responsive to the bias of the keeper ring spring 41 and the cable release mechanism 1 is again in functional configuration for towing.

In a most preferred embodiment of the invention and referring again to FIGS. 3*a*–3*d* of the drawings, the ring 39 can be used in cooperation with the spacer plate flanges 43, which project from the spacer plate 42 in spaced relationship, to manually release the keeper ring 13 from the keeper ring seat 6 in the event of a malfunction of the cylinder 8. Accordingly, in the event of an emergency during the towing operation and should the cylinder 8 fail to operate to remove the keeper ring 13 from engagement with the keeper ring seat 6 of the pelican hook 5, the ring 39 can be quickly engaged by a large screwdriver, bar or other elongated tool and forced outwardly of the spacer plate 42 by leverage against one of the spacer plate flanges 43, to move the keeper ring bolt 16 against the bias of the keeper ring spring 41 and remove the keeper ring 13 from contact with the keeper ring seat 6.

Referring again to FIG. 1, it will be appreciated by those skilled in the art that the cable release mechanism 1 of this invention can be mounted to the tow boat deck 20 of the towboat 22 in a variety of ways, including bolting and welding, in non-exclusive particular and in a variety of positions, depending upon the desired location of the winches 24. Furthermore, it will also be appreciated that the cable release mechanism 1 can be used with or without the winches 24, as deemed expedient by the operator, to rig a barge 32 or other barge tows or strings to the towboat deck 20. Furthermore, the orientation and design of the solenoid valves 25, air filters 26, compressor 27 and control panel 28 will necessarily vary with the particular installation chosen, the specific orientation and installation of the cable release mechanism 1 illustrated in FIG. 1 being illustrative only.

Referring again to FIGS. 2 and 3*d* of the drawings, in another most preferred embodiment of the invention the cable seat 12 provided in the pelican hook 5 is about four inches in length, measured around the curved face from end to end and about $1\frac{1}{8}$ inch in width, from the top edge 50 to the bottom edge 30, in order to fully support a tow cable 29. having a diameter of up to about $1\frac{1}{2}$ inches. This wide bearing surface helps to prevent excess flattening of the cable loop 17 and serves to extend the lift of the cable 29. Furthermore, the design of the cable seat 12 is also intended to accommodate both wire cables and hemp ropes, as well as any other towing line or rigging which may be used in the trade.

It will be appreciated by those skilled in the art that the cable release mechanism 1 can be utilized in one embodiment with the keeper ring 13, keeper ring bolt 16, keeper ring spring 41, ring nut 40 and ring 39 combination used in lieu of the cylinder 8 and piston 11. In contrast, this combination can be omitted, with the exception of the keeper ring 13, in favor of operating the cable release mechanism 1 in automatic mode, with only the cylinder 8 and piston 11. However, as heretofore described, both release apparatus are preferred, the manually operated apparatus serving as an override mechanism in the event of failure of the automatic equipment.

In yet another most preferred embodiment of the invention it has been found that an optimum location of the cable seat 12 is alignment of the bottom edge 30 with the center line of the horizontal axis of the hinge pin 4, or slightly above this axis. This orientation of the cable seat 12 facilitates positioning of the tow cable loop 17 on the cable seat 12 with the rearward force vector in the tow cable loop 17 slightly above the horizontal axis of the hinge pin 4, in order to insure immediate opening of the pelican hook 5 upon disengagement of the keeper ring 13, with minimum stress between the keeper ring 13 and the keeper ring seat 6 when the cylinder 8 is energized.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a cable release mechanism having a base, a pair of hinges in upward-standing relationship on the base, a pelican hook pivotally mounted on the hinges and a keeper ring in slidable cooperation with the base and normally engaging the free end of the pelican hook to retain a towing cable against the pelican hook, the improvement in combination therewith comprising a fluid-operated cylinder carried by said base and a piston cooperating with said cylinder in reciprocating relationship and having one end extending from said cylinder, said one end of said piston in contact with the keeper ring for selective disengagement of the keeper ring from the free end of the pelican hook responsive to fluid activation of said cylinder and release of the cable from the pelican hook and further comprising elongated connecting means having one end secured to the keeper ring on the opposite side of the keeper ring from said piston and bias means in cooperation with said connecting means for biasing the keeper ring against said piston.

2. The cable release mechanism of claim 1 further comprising a block secured to the keeper ring and wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of the keeper ring from the free end of the pelican hook independently of the operation of said cylinder and said piston.

3. The cable release mechanism of claim 1 further comprising:

a curved cable seat on the pelican hook for receiving the towing cable.

4. The cable release mechanism of claim 3 wherein the bottom edge of said cable seat is in a horizontal plane substantially co-extensive with the axis of pivot of the pelican hook.

5. The cable release mechanism of claim 4 further comprising a block secured to the keeper ring and wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of the keeper ring from the free end of the pelican hook independently of the operation of said cylinder and said piston.

6. The cable release mechanism of claim 5 further comprising flange means extending outwardly from said spacer plate in spaced relationship on each side of said engaging means.

7. The cable release mechanism of claim 6 wherein said engaging means is a ring.

8. The cable release mechanism of claim 1 further comprising a keeper ring plate carried by the base and a slot in said keeper ring plate and wherein the keeper ring extends through said slot.

9. The cable release mechanism of claim 1 further comprising:

a curved cable seat on the pelican hook for receiving the towing cable; and a keeper ring plate carried by the base and a slot in said keeper ring plate and wherein the keeper ring extends through said slot.

10. The cable release mechanism of claim 9 wherein the keeper ring is further characterized by a pair of keeper plates spaced by a block and further comprising a top shim and a bottom shim, said top shim normally in engagement with the free end of the pelican hook when said cable release mechanism is in towing configuration and said bottom shim in registration with said slot in said keeper ring plate.

11. The cable release mechanism of claim 10 further comprising a block secured to said keeper plates and wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of said top shim in the keeper ring from the free end of the pelican hook independently of the operation of said cylinder and said piston.

12. The cable release mechanism of claim 11 further comprising flange means extending outwardly from said spacer plate in spaced relationship on each side of said engaging means and wherein the bottom edge of said cable seat is in a horizontal plane substantially co-extensive with the axis of pivot of the pelican hook.

13. The cable release mechanism of claim 12 wherein said engaging means is a ring.

14. In a cable release mechanism having a base, a pair of hinges in upward-standing relationship on the base, a pelican hook pivotally mounted on the hinges, a keeper ring plate located on the base and a slot provided in said keeper ring plate, the improvement in combination therewith comprising a keeper ring characterized by a pair of keeper plates spaced by a block and further comprising a top shim and a bottom shim, said top shim normally in engagement with the free end of the pelican hook when said cable release mechanism is in towing configuration and said bottom shim in registration with said slot in said keeper ring plate and elongated connecting means having one end secured to said block and bias means in cooperation with said connecting means for biasing said top shim on the free end of the pelican hook.

15. The cable release mechanism of claim 14 wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of the keeper ring from the free end of the pelican hook.

16. The cable release mechanism of claim 14, further comprising a curved cable seat on the pelican hook for receiving the towing cable.

17. The cable release mechanism of claim 14 wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of the keeper ring from the free end of the pelican hook; and further comprising a curved cable seat on the pelican hook for receiving the towing cable.

18. The cable release mechanism of claim 17 wherein the bottom edge of said cable seat is in a horizontal plane substantially co-extensive with the axis of pivot of the pelican hook.

19. The cable release mechanism of claim 14 further comprising a keeper ring plate carried by the base and a slot in said keeper ring plate and wherein the keeper ring extends through said slot.

20. The cable release mechanism of claim 14 wherein said connecting means is a bolt having a bolt head secured to said block and said bias means further comprises a spacer plate secured to the base; a plate aperture in said spacer plate receiving the opposite end of said bolt in slidable relationship; engaging means cooperating with said opposite end of said bolt; and a spring disposed on said bolt between said bolt head and said spacer plate, whereby a force exerted on said engaging means outwardly of said spacer plate compresses said spring and forces disengagement of the keeper ring from the free end of the pelican hook; and further comprising a curve cable seat on the pelican hook for receiving the towing cable, the bottom edge of said cable seat positioned in a horizontal plane substantially co-extensive with the axis of pivot of the pelican hook.

* * * * *